US006050369A

United States Patent [19]

Leone et al.

[11] Patent Number: 6,050,369

[45] **Date of Patent: *Apr. 18, 2000**

[54] ELEVATOR SHAFTWAY INTRUSION DEVICE USING OPTICAL IMAGING PROCESSING

[75] Inventors: Richard J. Leone; Robert F. Cummins, both of Yonkers; Joseph Vitiello, Riverdale; Thomas Brochhagan, No. Bellmore, all of N.Y.

[73] Assignee: TOC Holding Company of New York, Inc., Bronx, N.Y.

[ * ] Notice: This patent is subject to a terminal disclaimer.

[21] Appl. No.: 08/320,140

[22] Filed: Oct. 7, 1994

[51] Int. Cl.[7] ..... B66B 1/34; B66B 1/24

[52] U.S. Cl. ..... 187/392; 187/280

[58] Field of Search ..... 187/392, 390, 187/391, 279, 280; 382/103, 325

[56] References Cited

U.S. PATENT DOCUMENTS

| | | | |
|---|---|---|---|
| Re. 33,668 | 8/1991 | Gray | 250/221 |
| 1,887,209 | 11/1932 | Lucas | 250/221 |
| 1,947,079 | 2/1934 | Ellis, Jr. | 187/52 |
| 2,109,361 | 2/1938 | Spiegel | 250/221 |
| 2,193,609 | 3/1940 | Williams et al. | 340/556 |
| 2,227,147 | 12/1940 | Lindsay | 250/221 |
| 2,417,092 | 3/1947 | Smith | 250/221 |
| 2,631,273 | 3/1953 | Bagno | 250/214 |
| 2,806,555 | 9/1957 | Suozzo | 187/29 |
| 2,900,521 | 8/1959 | Eames | 250/221 |
| 2,909,767 | 10/1959 | Zaltman | 340/556 |
| 3,091,760 | 5/1963 | Spenard et al. | 340/375 |
| 3,168,164 | 2/1965 | Kiely | 250/221 |
| 3,176,797 | 4/1965 | Dinning | 250/221 |
| 3,207,266 | 9/1965 | Hornung | 187/29 |
| 3,370,285 | 2/1968 | Cruse et al. | 340/556 |
| 3,461,422 | 8/1969 | Hansen | 340/21 |
| 3,545,572 | 12/1970 | Hallene et al. | 187/52 |
| 3,605,082 | 9/1971 | Matthews | 340/258 |
| 3,609,730 | 9/1971 | Hornung | 340/214 |
| 3,641,549 | 2/1972 | Misek | 340/258 B |
| 3,644,917 | 2/1972 | Perlman | 340/258 B |
| 3,742,222 | 6/1973 | Endl | 250/209 |
| 3,745,550 | 7/1973 | Anthony et al. | 340/258 B |
| 3,746,863 | 7/1973 | Pronovost | 250/208 |
| 3,760,397 | 9/1973 | Taggart | 340/258 B |
| 3,773,145 | 11/1973 | Drexler | 187/29 R |
| 3,816,745 | 6/1974 | Primm et al. | 250/221 |
| 3,825,745 | 7/1974 | Thomson | 250/208 |
| 3,857,466 | 12/1974 | Berkovitz et al. | 187/52 |
| 3,903,996 | 9/1975 | Berkovitz | 187/52 |
| 3,914,753 | 10/1975 | Cho | 340/258 B |
| 4,009,389 | 2/1977 | Lindholm | 250/221 |
| 4,052,716 | 10/1977 | Mortensen | 340/233 |
| 4,067,416 | 1/1978 | Lowry | 187/29 R |
| 4,092,636 | 5/1978 | Shepherd, Jr. | 340/274 R |

(List continued on next page.)

OTHER PUBLICATIONS

Article titled "Scots Develop Miniature Camera," Photonics Spectra, Jul. 1993, p. 34.

Article titled "Optical Processing: Ready for Machine Vision?" Photonics Spectra, Aug. 1993, pp. 101–106.

Abstract of Japanese Patent Ref. No. 2–169482(A) Tajima, Jun. 29, 1990.

Abstract article titled "Alternative Safety Equipment at Elevators," Heimplaetzer, Jun. 1990.

Bulletin P.A. 8103, "Photoswitch," Alan Bradley Co., Nov. 1988.

*Primary Examiner*—Robert Nappi

*Attorney, Agent, or Firm*—Daniel A. DeVito; Skadden, Arps, Slate, Meagher & Flom LLP

[57] ABSTRACT

There is provided an elevator shaftway intrusion detector which utilizes an image detector including a camera for generating a detection field within a zone of detection including the elevator shaft-side roof and floor and an image processing means for generating a detection signal upon an attempted entry. A power supply and switching network are employed for applying power from the power supply to the image detector and processor which are responsive to the detection signal for applying power from the power supply to a detection indicator such as a siren.

11 Claims, 9 Drawing Sheets

U.S. PATENT DOCUMENTS

| | | | |
|---|---|---|---|
| 4,108,281 | 8/1978 | Glaser | 187/29 R |
| 4,207,466 | 6/1980 | Drage et al. | 250/338 |
| 4,266,124 | 5/1981 | Weber | 250/221 |
| 4,326,197 | 4/1982 | Evin | 340/561 |
| 4,384,280 | 5/1983 | Haag | 340/556 |
| 4,399,430 | 8/1983 | Kitchen | 340/550 |
| 4,460,066 | 7/1984 | Ohta | 187/29 R |
| 4,479,053 | 10/1984 | Johnston | 250/221 |
| 4,507,654 | 3/1985 | Stolarczyk et al. | 340/545 |
| 4,520,343 | 5/1985 | Koh et al. | 340/19 R |
| 4,581,526 | 4/1986 | Brattgard | 250/221 |
| 4,590,410 | 5/1986 | Jonsson | 318/480 |
| 4,644,329 | 2/1987 | Brueske | 340/556 |
| 4,716,992 | 1/1988 | Kunii | 187/121 |
| 4,733,081 | 3/1988 | Mizukami | 250/341 |
| 4,742,337 | 5/1988 | Haag | 340/556 |
| 4,839,631 | 6/1989 | Tsuji | 340/541 |
| 4,879,461 | 11/1989 | Philipp | 250/221 |
| 4,893,005 | 1/1990 | Stiebel | 250/221 |
| 4,897,630 | 1/1990 | Nykerk | 340/426 |
| 4,910,464 | 3/1990 | Trett et al. | 328/5 |
| 4,942,385 | 7/1990 | Kobayashi et al. | 340/556 |
| 4,973,837 | 11/1990 | Bradbeer | 250/221 |
| 4,976,337 | 12/1990 | Trett | 187/51 |
| 4,987,402 | 1/1991 | Hykerk | 340/426 |
| 5,015,840 | 5/1991 | Blau | 250/221 |
| 5,025,895 | 6/1991 | Leone et al. | 187/105 |
| 5,053,616 | 10/1991 | Trett | 250/221 |
| 5,138,150 | 8/1992 | Duncan | 250/221 |
| 5,149,921 | 9/1992 | Picado | 187/130 |
| 5,182,776 | 1/1993 | Suzuki et al. | 382/14 |
| 5,258,586 | 11/1993 | Suzuki et al. | 187/124 |
| 5,283,400 | 2/1994 | Leone et al. | 187/140 |
| 5,347,094 | 9/1994 | Leone et al. | 187/140 |
| 5,387,768 | 2/1995 | Izard et al. | 187/392 |

ELEVATOR SHAFTWAY INTRUSION DEVICE USING OPTICAL IMAGING PROCESSING

This invention relates to intelligent elevator control systems and in particular to an improved intrusion detector for detecting unauthorized entry to the elevator shaftway for use in such systems.

BACKGROUND OF THE INVENTION

As currently designed, intelligent elevator systems incorporate built-in safety precautions to ensure that no injury will be inflicted upon users during the normal operation of the elevator. Such devices include pressure-sensitive elements to determine pressure put on a door while it is closing, optical elements to determine when someone has passed through the elevator doorway, speed tolerance governing and braking devices and the like. Recently, particularly in urban areas having many high-rise structures, people have gained access to the shaft-side roof of the elevator cab through artful and wrongful manipulation of the elevator system. One common form of unauthorized access to elevator car tops is through the placement of strings on the roller release assembly of the elevator door interlock when the elevator is servicing a floor. Once the string is attached to the interlock release assembly, the elevator doors close normally, and the elevator is sent to the next lower floor. When the elevator arrives at the next lower floor, the shoe string is pulled on the floor above allowing the exterior hoistway door to open, which in turn allows access to the top of the elevator car.

While some access to the roof of the elevator car is necessary for the performance of maintenance and repairs on the system, unauthorized entry is extremely dangerous and can easily result in severe injury or death. Thus, a need exists for a device which can detect an unauthorized intrusion and initiate a proper response upon detection. Because of the special nature of the operating environment of an elevator shaft, there exists several problems not readily ascertainable or solvable by the use of a wide variety of detection techniques. For example, the constant vibration of the elevator cab within the shaft would cause severe problems for a reflective optical system because of the misalignment created between source and reflector by the vibrations. Similarly, false detections can easily be made because of the effect on a beam caused by the high volume of dust and particles present in the shaft space. Pressure sensitive detectors are also not a viable alternative because of the extreme pressure changes which occur in the shaft as the elevator cab moves within it. Further, these systems do not lend themselves to servicing nor do they permit the elevator system to return to normal operation when an intruding object is removed. A need exists, therefore, for a reliable detection device which can be easily installed and maintained, and which can accurately detect the entry onto an elevator cab roof without giving false warnings.

It is an object of the present invention to provide a reliable intrusion detection system for use on the shaft-side roof of an elevator cab.

It is a further object of the present invention to provide an intrusion detection system for use on the shaftside roof of an elevator cab which can detect an unauthorized entry onto the roof and produce an appropriate response.

It is a further object of the present invention to provide an intrusion detection system for use on the shaft-side roof of an elevator cab which will not produce false indications of an intrusion based on the operating environment of the elevator shaft and which will allow the elevator system to be easily serviced and will allow it to return to normal operation if an object intrudes upon the cab roof and is immediately thereafter removed from the cab roof.

It is a still further object of this invention to employ a proximity detection system in conjunction with a switching network to detect unauthorized entry onto a elevator cab roof on the shaft-side of the cab.

It is also an object of this invention to implement an image detection and processing system to detect the presence of unauthorized persons on the elevator cab roof on the shaft-side of the cab.

SUMMARY OF THE INVENTION

These and other objects of the invention are achieved in accordance with one aspect of the present invention by the use of an image detection means for obtaining image information corresponding to a zone of detection including the elevator shaft-side roof or floor. The image detection means is coupled to an image processor that analyzes the information obtained from the image detection means to determine unauthorized entry onto the shaft-side roof or floor of the elevator.

DETAILED DESCRIPTION OF THE PREFERRED EMBODIMENT

Figure 1:
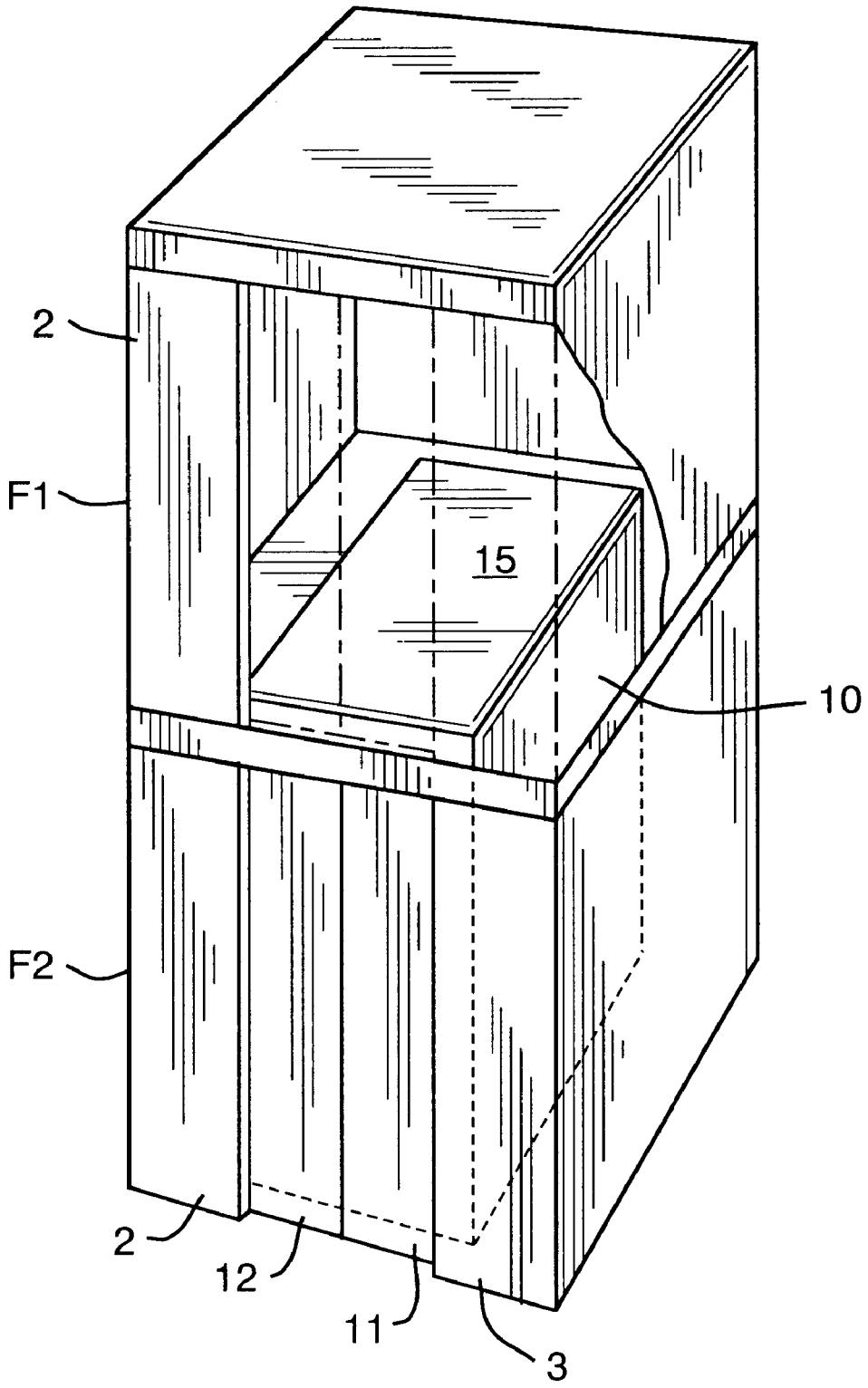
FIG. 1 is pictorial representation showing two floors of an elevator system.

In FIG. 1, an elevator shaft 1 is shown in section along two floors F1 and F2. Each floor has a set of hoistway doors 2, 3 which block entry to the elevator shaft when the elevator car is not servicing that floor and allow entry to the car when it is servicing the floor. In FIG. 1, the elevator car 10 is shown in phantom line servicing floor F2. The elevator car doors 11, 12 are shown closed on floor F2. On floor F1, the hoistway door 2 is retracted and door 3 is not shown. As shown, when the hoistway doors 2, 3 on floor F1 are manipulated to remain open when the elevator is servicing floor F2, the shaft-side roof 15 of elevator car 10 is visible and accessible from floor F1 through the shaft opening created by the retracted hoistway doors 2, 3 on floor F1.

Figure 2:
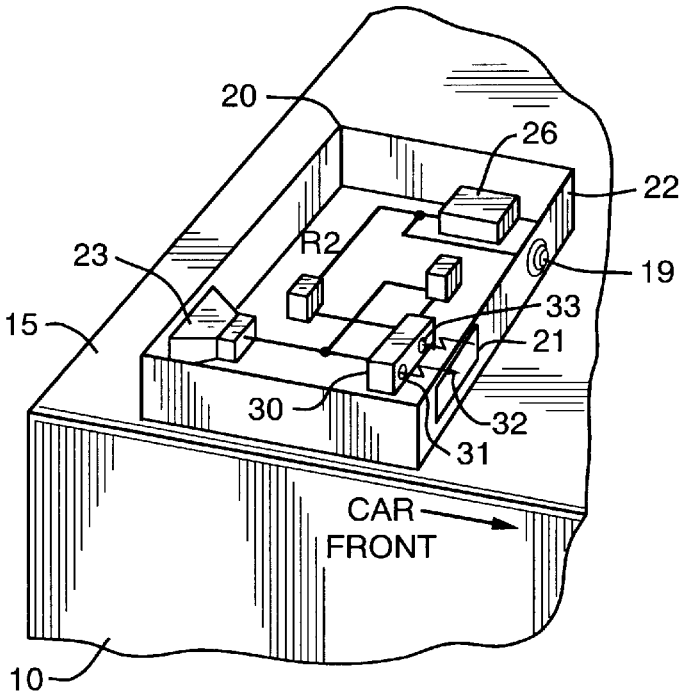
FIG. 2 is a pictorial representation showing the present invention disposed in a housing and mounted on the shaft-side roof of an elevator car.

FIG. 2 is a pictorial representation of the present invention disposed in a housing 20 mounted on the shaft-side roof 15 of elevator car 10. The arrangement of FIG. 2 is shown schematically in FIG. 3.

A proximity detection unit 30 is mounted in the housing such that it aligns with a beam aperture 21 formed in a lateral side 22 of the housing 20. Proximity detection unit 30 contains a modulated light emitting diode 31 which generates a detection beam 32 inside the elevator shaft proximate the location of the elevator car roof 15. Proximity detection unit 30 also includes a photodetector cell 33 designed to receive and detect a diffusion of the beam 32 if and when an object enters the path of the emitted detection beam 32. A commercially available and acceptable device for unit 30 is an Allen Bradley Type 42MR Photodetector.

Figure 3:
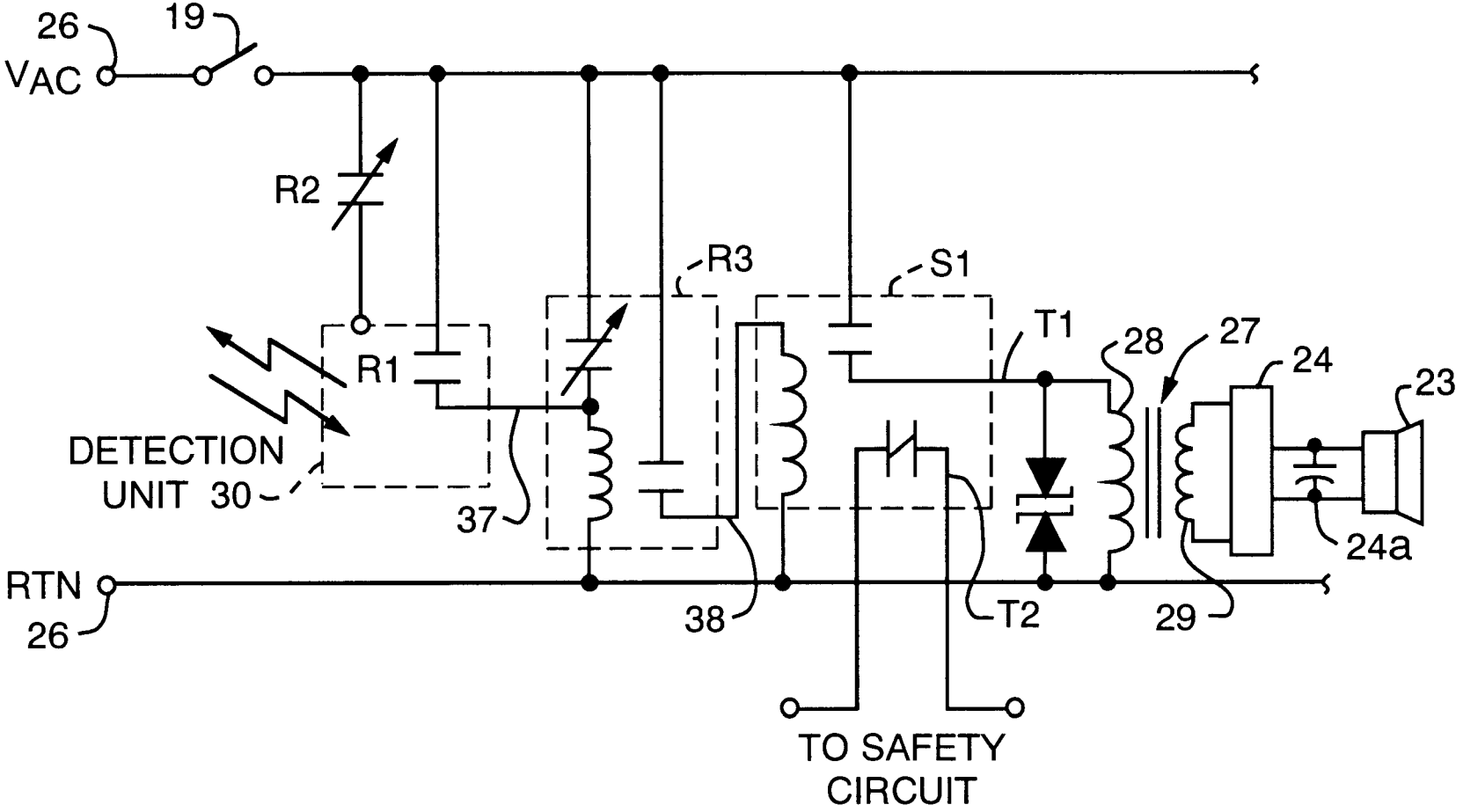
FIG. 3 is a schematic representation of the system of FIG. 2 with no power applied.

As shown in FIG. 3, the proximity detection unit 30 receives primary power from a power supply unit 26 and is electrically connected to an in-line delay-on-make timer relay R2. The power supply unit can be replaced by tapping the main line of the elevator system. The proximity detection unit 30 has an internal switching system R1 which is described in greater detail hereinbelow.

Figure 2A:
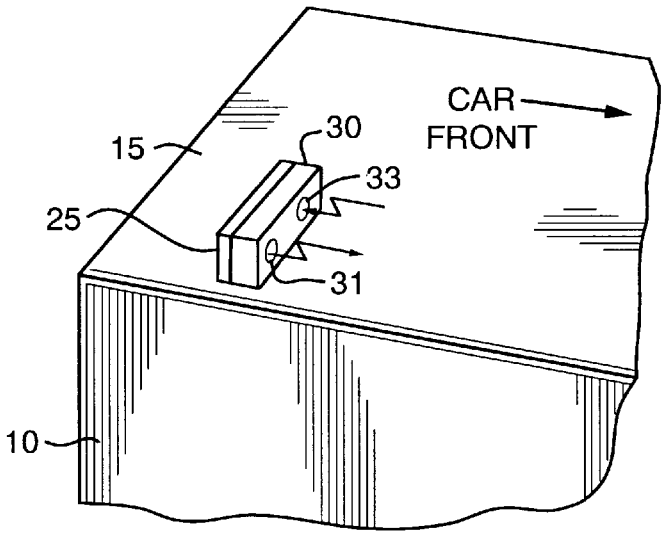
FIG. 2A is an alternative embodiment of the present invention.

The output 37 of internal system R1 is in turn in electrical connection with an in-line delay-on-break timer relay R3 which acts to latch a signal presented at its input by relay R1. The output 38 of relay R3 is electrically connected to a four-pole switching network S1. One side of the primary tap 28 of step-down transformer 27 is electrically tied to the switch S1 at terminal T1. Switch S1 also has a pair of normally closed contacts T2 electrically connected in series with other safety devices and ultimately to an external elevator safety circuit. Typically, transformer 27 will step down the available 110 V-AC line to 12 volts. The secondary tap 29 of transformer 27 drives an audible warning indicator siren 23 across a rectifier circuit 24 and filter capacitor 24*a*. It will be appreciated by those of ordinary skill in the art that relays R2 and R3, switching network S1 and the associated control signals produced in accordance with the delay-on make and delay-on-break functions can be replaced by an electronic circuit including, respectively, appropriate power MOSFET's (metal oxide semiconductor field effect transistors) or bipolar transistors, an appropriate power transistor amplifier to drive the audible warning indicator, and appropriate control circuitry. In this case, the housing 20 may be replaced by a printed circuit board 25 as shown in FIG. 2*a*.

Figure 4:
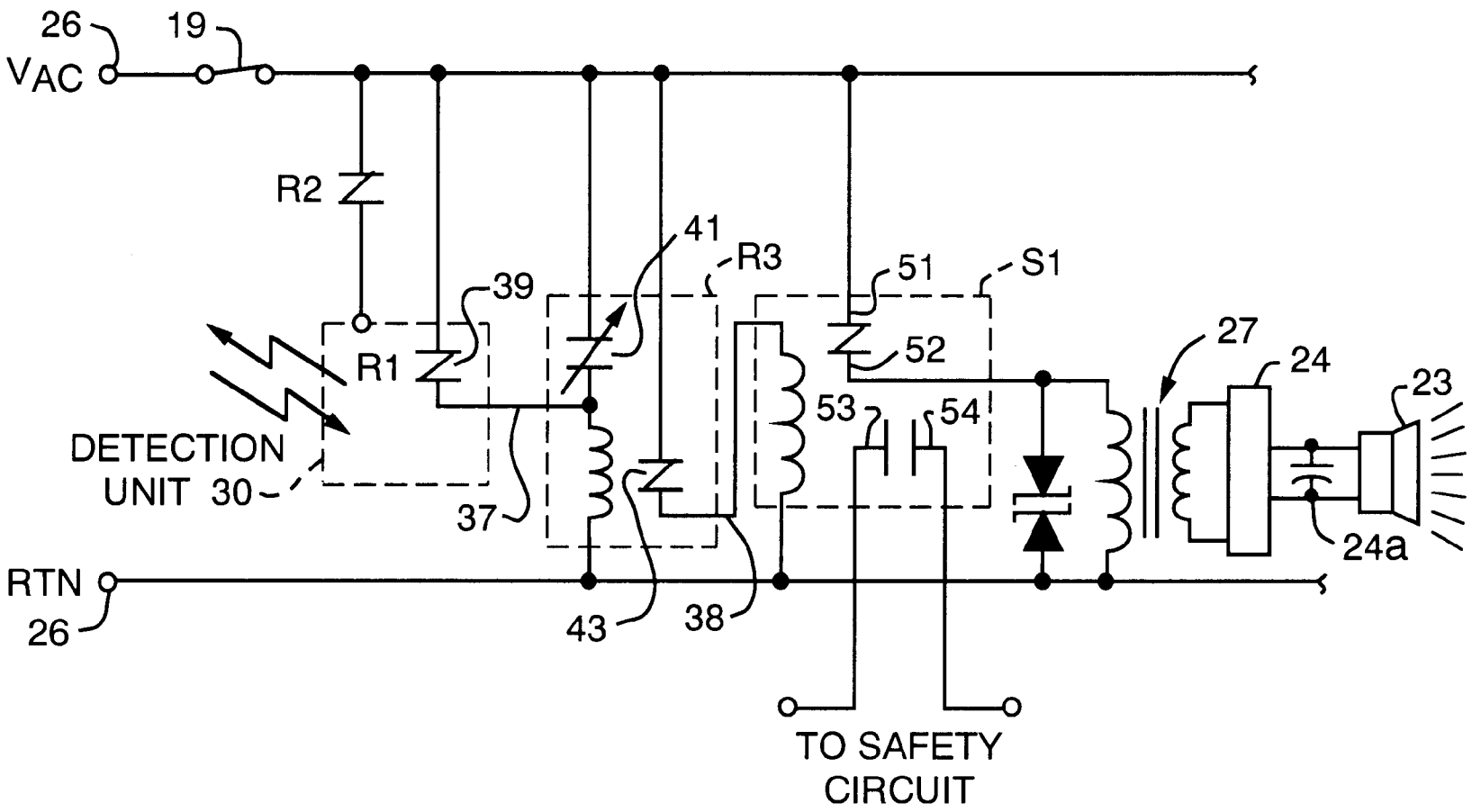
FIG. 4 is a schematic representation of the system of FIG. 2 with power applied.

The schematic diagram shown in FIG. 3 represents a condition in which no power has yet been applied to the system. With reference to FIG. 4 the operation of the present invention is described when it is armed and an object, such as a person, has entered upon the shaft-side roof of the elevator cab. The system is initially armed by turning key-switch 19 to the on position. In-line delay-on make timer relay R2 closes its contacts a certain elapsed time after key-switch 19 is turned to the position. This allows the operator sufficient time to arm the system and exit the elevator cab roof without setting off the alarm. Power is supplied through timer relay R2 to the photohead circuit of detection unit 30. When photohead 33 detects the diffusion of beam 32 from the object in the detection zone, contacts 39 of internal, switching system R1 are closed, thereby energizing the coil of latching relay R3. The operation of latching relay R3 is such that even if the object leaves the detection zone, thereby opening relay contacts 39, the delay-on-break function will keep contacts 41 of relay R3 closed for a predetermined amount of time. This has the effect of keeping the coil of relay R3 energized and the detection signal latched at relay R3 for a predetermined amount of time. Once relay R3 is energized, the contacts 43 will close to provide power to and energize the coil of switch S1, which has normally open contacts 51 and 52 and normally closed contacts 53 and 54. The normally open contacts 51 and 52 close upon energization of the switch coil and act to supply power to transformer 27, thereby activating siren 23. Normally closed contacts 53 and 54 are connected in series with other safety devices of the elevator safety circuit. Upon energization of the switch coil, contacts 53 and 54 create an open circuit in the safety circuit which causes the elevator to cease operation and carry out functions in accordance with the predetermined algorithmic scheme of the safety circuit. If the object leaves the detection zone, as stated above, the siren 23 will produce a warning signal for a period of time equal to the latching period of relay R3 and, thereafter, control of the elevator will return to the normal operating system. If the object remains in the detection zone, the audible warning signal and open safety circuit will be continuously produced. Alternatively, the system may be designed to discontinue elevator service when an object has entered and subsequently been removed from the roof of the elevator car by always keeping the safety circuit open. This may be accomplished by simply omitting the in-series connection of normally closed terminals 53 and 54 of switch S1 and replacing it with a switching mechanism which is adapted to open and remain open each and every time an intrusion is detected.

Although the embodiment of the invention described herein is described for use on the shaft-side roof of an elevator car, it can similarly be used to detect intrusion of the elevator shaft in the area below the elevator by simply mounting a unit on the shaft-side floor of the elevator car.

Other forms of energy may also be used to carry out the functions of detection unit 30. For example, sound or micro wave transmitters and receivers could be used in place of the optical-based units described above. A commercially available acoustic based unit which can be used in the circuit of FIG. 3 in place of detection unit 30 is the Massa M-4000 system described in *Sensors*, Vol. 6, No. 11, November, 1989.

Figure 5:
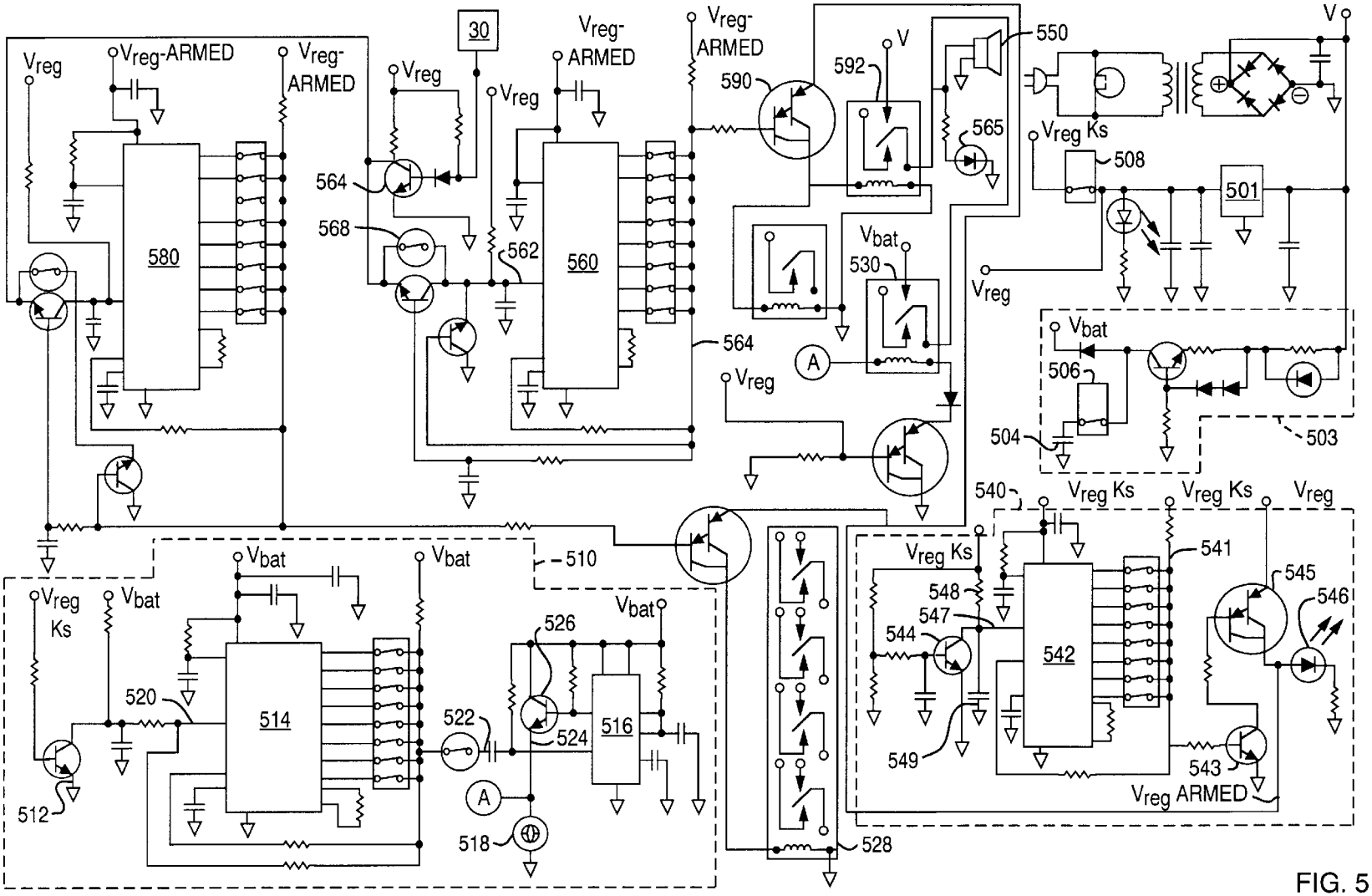
FIG. 5 is a schematic of an alternative circuit for implementing the present invention.

FIG. 5 shows a second circuit configuration which includes features in addition to those shown in the circuit of FIG. 3. Referring to FIG. 5, an AC voltage source is applied through a step-down transformer to an 8-volt DC regulator 501 and to a battery backup circuit generally labelled as 503. The regulated DC Voltage Vreg is applied to various inputs of the circuit of FIG. 5, as is described below, and is also selectively supplied to other circuit inputs as Vregks through an arming key switch 508. When voltage V is present, a battery 504 is charged through the conventional charge circuit 503. A voltage Vbat from battery 504 is selectively supplied to a chirping circuit 510 through a battery disable key switch 506.

Chirping circuit 510 includes a transistor 512, a chirp timer 514, a one-shot pulse generator 516 and a piezoelectric transducer 518. The operation and circuit connections of these elements are well known to users of these conventional devices. In operation, when the backup chirping circuit is enabled by virtue of key switch 506 being closed, power is supplied to the chirp timer 514, and the one-shot 516 by way of voltage Vbat. If voltage Vreg is present, transistor 512 is turned on and the trigger input 520 of chirp timer 514 is held low. Since no transitions occur on the trigger input 520 while Vreg is present, no sound is produced by transducer 518. Once Vreg is removed, transistor 512 turns off, causing a transition on input 520. Once triggered, the timer will produce a periodic output signal on output 522 based on the configuration of the output control signals of the chirp timer 514. Transitions in the output signal 522 in turn cause one-shot 516 to trigger, producing a periodic pulse at output 524, thereby turning transistor 526 on and off. This results is an audible output from piezoelectric transducer 518. Thus, transducer 518 chirps because it will be audible only during the duration of the pulse on output 524, which is produced once every cycle of the output signal 522.

The output 524 is also supplied to one end of the coil of a relay 530 to energize it during the audible period of transducer 518. Once energized, relay 530 supplies voltage Vbat to siren 550 causing it to sound during the same period that transducer 518 is audible.

If key switch 506 is an open position, voltage Vbat is not supplied to circuit 510 or relay 530 and no sound is produced if voltage Vreg is removed.

When arming key switch is closed to activate the system, Vregks is applied to turn-on delay circuit 540 which includes a conventional timer 542, transistors 544 and 545 and light-emitting diode 546. Vregks is applied immediately to timer 542 to power it up and also to the output 541 of timer 542 through a pull up resistor to ensure that the output 541 remains high. Vregks is also applied to the trigger input 547 of timer 542, which is connected to the collector of transistor 544, and to the base of transistor 544 through respective RC networks. Thus, input 547 is pulled high after the RC time constant determined by resistor 548 and capacitor 549. This transition causes timer 542 to trigger. The time constant associated with the RC network connected to the base of transistor 544 is longer than the RC time constant of components 548 and 549. Thus, some time after the transition on input 547 from low to high, transistor 544 will turn on, thereby clamping input 547 to ground. This ensures that there will be no further transitions on input 547.

Once triggered, the timer 542 will produce a low output pulse on output line 541 for a duration determined by the configuration of the output control signals of the timer 542. During the period when output 541 is held low, NPN transistor 543 is off, which turns PNP transistor 545 off. The emitter of PNP transistor 545 is connected to Vreg. Since transistor 545 is off during the period when output 541 is low, voltage Vreg is not supplied to siren-on timer 560, auxiliary timer 580, or transistor 590. This ensures that no warning will be produced by siren 550 during the period when output 541 is low, which is adjusted to allow an operator sufficient time to arm the system by turning on key switch 508 and to exit the area of the top of the elevator car.

Once output 541 goes high after the pre-determined turn-on period, transistor 543 turns on, which in turn causes transistor 545 to turn on, producing a voltage Vregarmed at the output of transistor 545. This voltage, Vregarmed is then supplied to power up siren-on timer 560 and auxiliary timer 580. It is also supplied to the emitter of transistor 590. The system is now armed for operation. LED 546 also turns on to indicate the unit is armed.

The output of unit 30 is an open-collector NPN transistor (not shown) whose emitter is connected to ground. During operation, if no object enters the zone of detection of unit 30, its open-collector output remains high. Since the base of transistor 564 is being pulled high by voltage Vreg and the open-collector output of sensor 30 is high, transistor 564 remains on and the trigger input 562 of timer 560 is clamped to ground through infinity switch 568. In this state, output 564 of timer 560 remains high and transistor 590 is off. Thus, no voltage is applied to the coil of relay 592 or to siren 550.

When detection unit 30 is triggered, its open collector output goes low, turning off transistor 564 and thereby creating a low to high transition on input 562 which causes siren-on timer 560 to trigger. As with timers 514 and 542, the output 564 of timer 560 will go low for a period determined by the configuration of the output control signals of timer 560, which will turn on transistor 590. This in turn supplies voltage to the coil of relay 592 to energize it. Once energized, the contacts of relay 592 supply voltage to siren 550 and an alarm LED 565.

The siren 550 will operate as long as the output 564 of timer 560 is low. Thus, even though the intruding object which caused the proximity sensor 30 to trigger is removed, thereby turning on transistor 564 and clamping input 562 to ground, the siren will continue to operate for the predetermined period set by the configuration of the output control signals of timer 560.

The operation of auxiliary timer 580 is identical to that of timer 560. The output of timer 580 is used to drive an auxiliary relay 582. This relay 582 can be used to indicate an alarm condition to a number of other elevator system inputs such as a fire alarm, external elevator safety circuit or a monitoring station.

Figure 6:
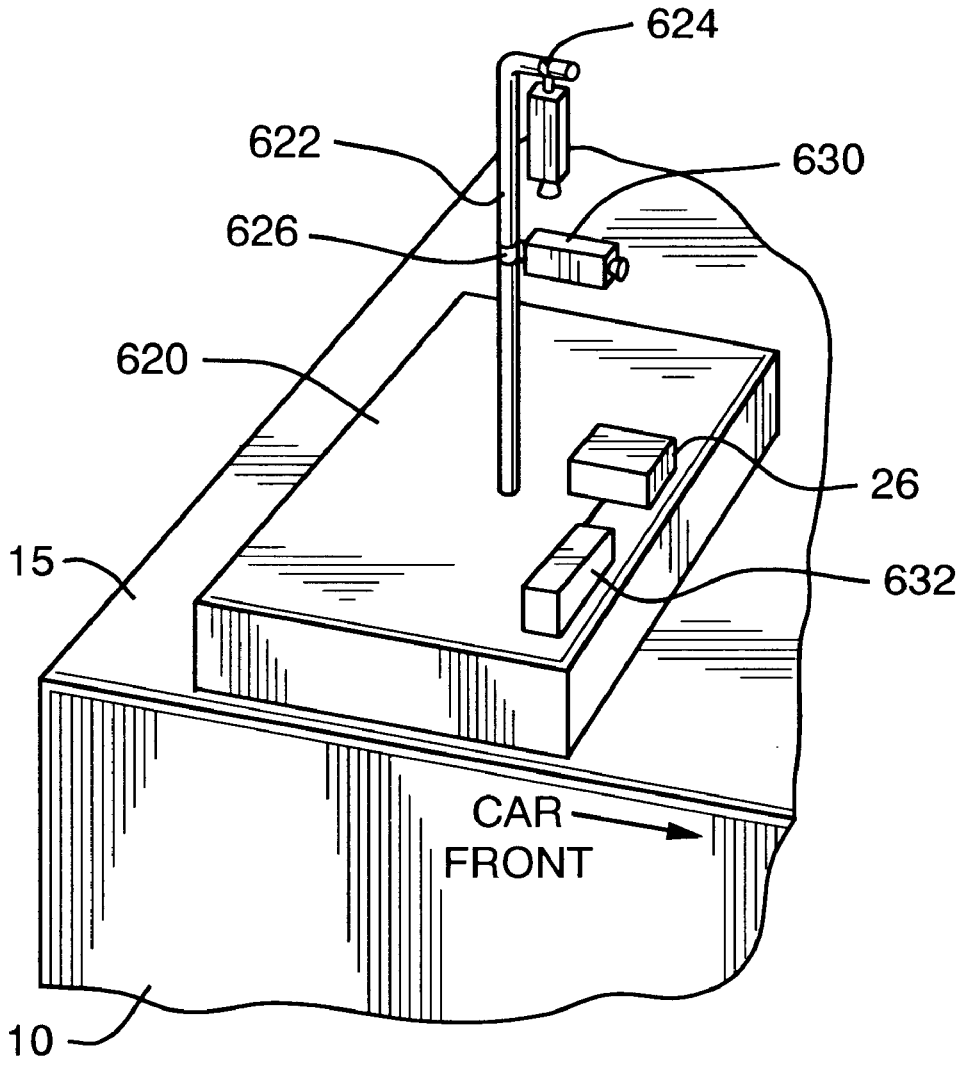
FIG. 6 is a pictorial representation showing another embodiment of the present invention disposed in a housing and mounted on the shaft-side roof of an elevator car.

Referring to FIG. 6 another system for detecting unauthorized entry onto the elevator cab roof 15 is shown pictorially. The detection system is disposed in housing 620, which is mounted on the shaft-side roof 15 of elevator car 10. Housing 620 supports a camera-mounting stand 622 for holding an image detector 630 at a fixed position in relation to the elevator cab roof 15. The image detector 630 can be disposed at location 624 of stand 622 such that a partial or entire image of the elevator cab roof 15 is within the detection zone of the image detector. Alternatively, the image detector can be disposed at a location 626 facing the elevator car front. Housing 620 also includes a power supply unit 26 coupled with an image processor unit 632. In another embodiment of the invention, the image detector 630 rather than being attached to the elevator car, is fixedly disposed in the elevator shaft at a location which provides an unobstructed view of the top of the elevator car. The image detector 630 is disposed at a high enough location in the shaft such that it never obstructs the movement of the elevator car. An automatic zoom mechanism adjusts the view of the image detector as the elevator car ascends towards the image detector or descends away from the image detector. The zoom mechanism assures that the image detector 630 has the same view of the top of the elevator car regardless of its distance from the car.

Figure 7:
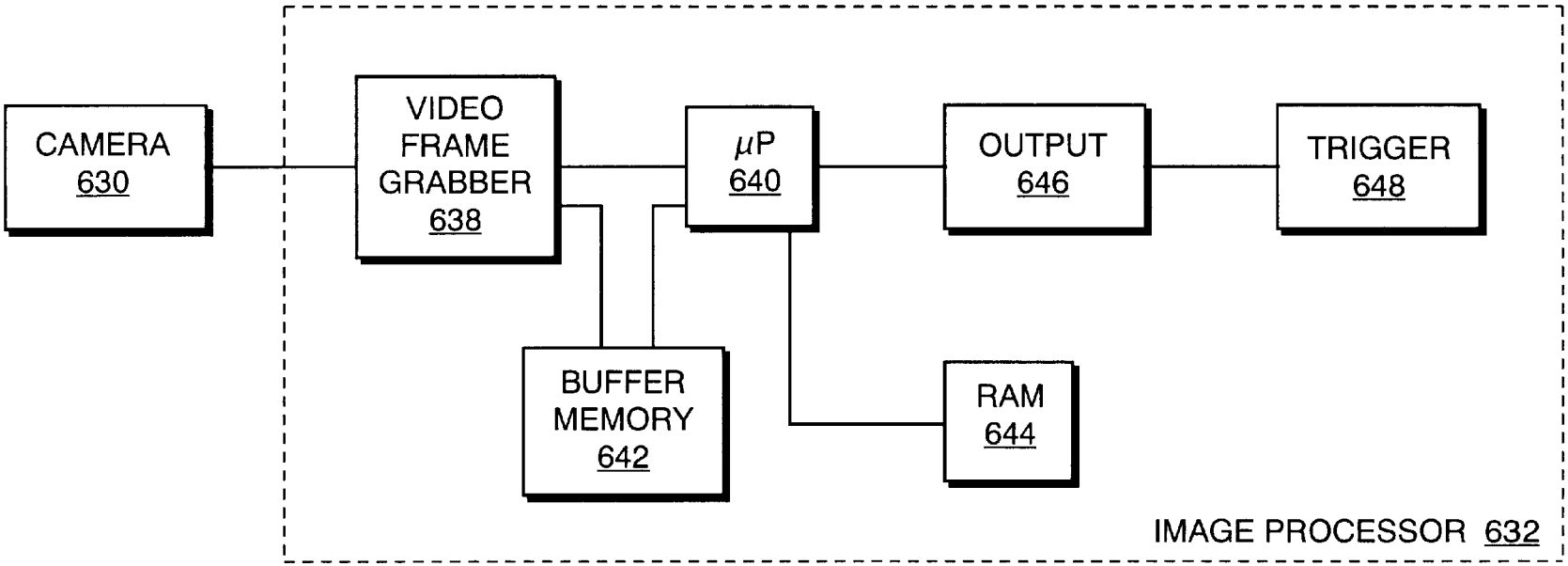
FIG. 7 is a schematic representation of the system of FIG. 6.
Figure 8A:
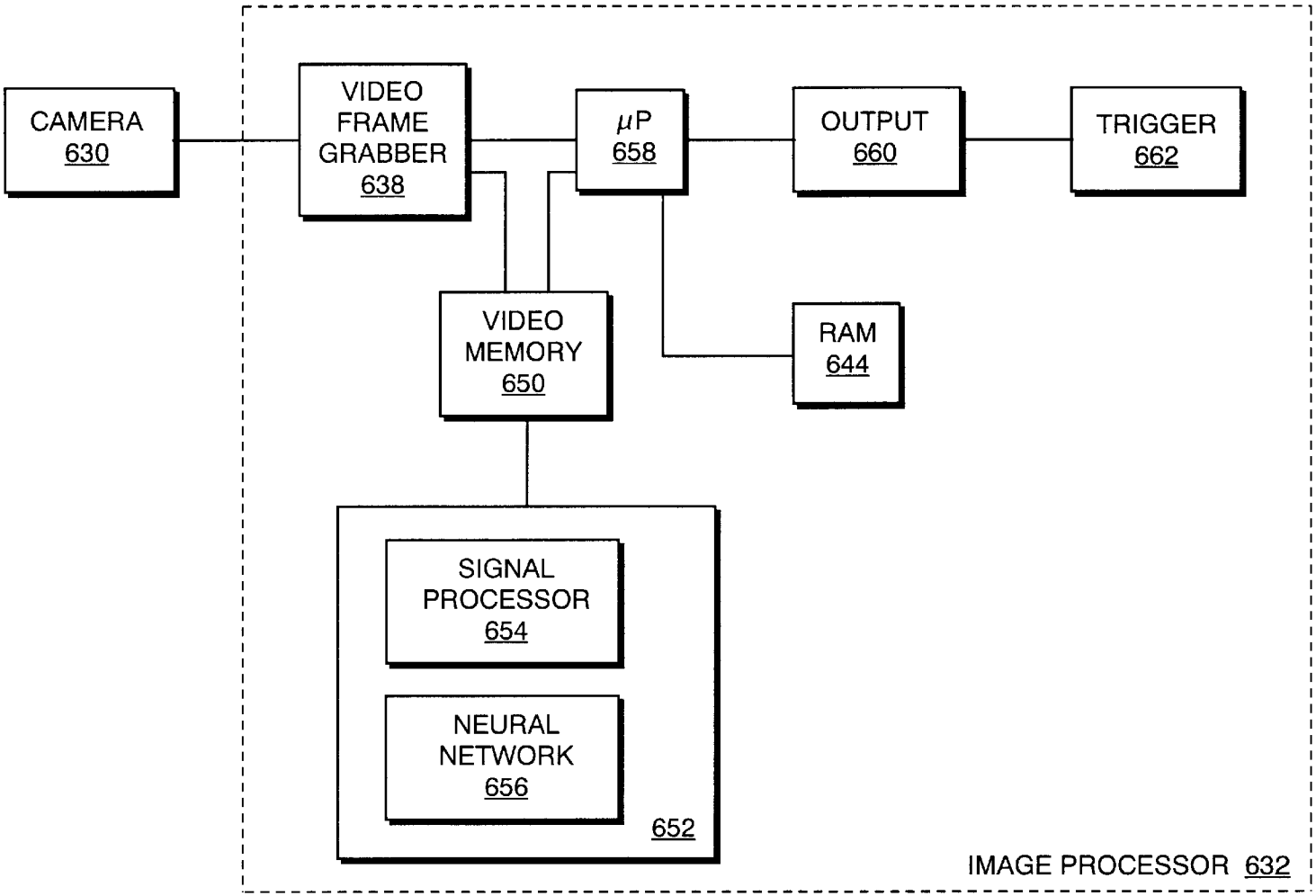
FIGS. 8(*a*) through 8(*c*) are alternative schematic representations of the system of FIG. 6.
Figure 8C:
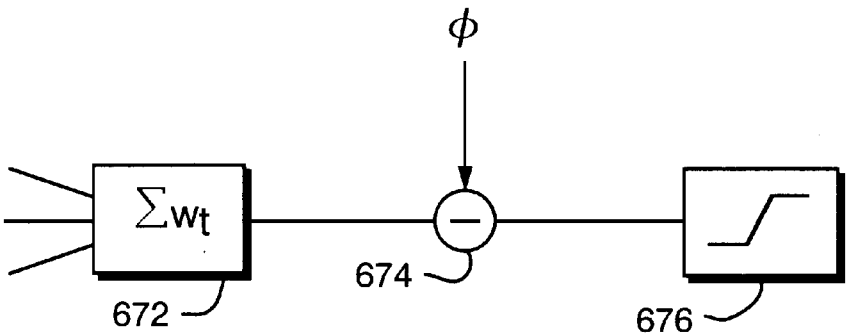
Figure 8B:
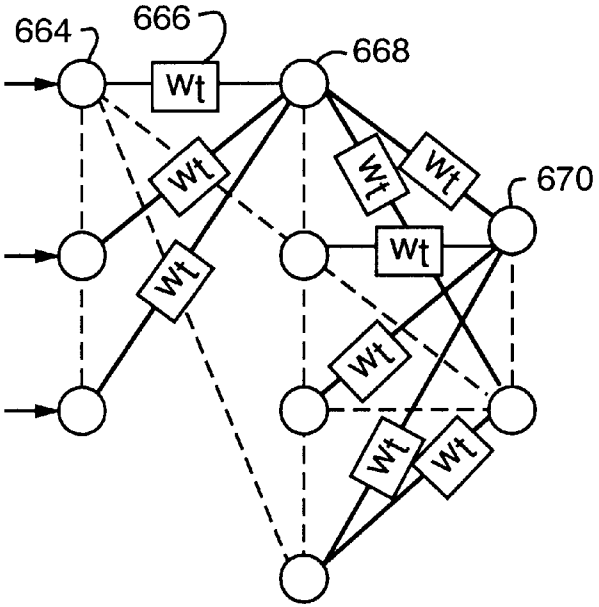

The arrangement of FIG. 6 is shown schematically in FIGS. 7 and 8. Referring to FIG. 7, image detector 630 is coupled to an image processor 632. The image detector may be a charged coupled device ("CCD") video camera capable of operating in the visible to infra-red region of the light spectrum. The camera receives information corresponding to the visual image within the detection angle of its lens in the form of pixel elements that together constitute the image. The output of the camera is a composite video signal, such as an analog RS-170(NTSC) or CCIR black and white format. In more sophisticated systems, a digital video output can be employed.

Alternatively, camera 630 can be a commercially available binary camera, which converts the information corresponding to each pixel into a group of digital data representing the brightness of each pixel. The grouping can be accomplished simply by distinguishing between a bright or dark spot in assigning a corresponding digital one or zero to the pixel, or by representations from white to black color in distinct levels of gray.

Camera 630 is capable of capturing images on a frame by frame basis. Each frame corresponds to a plurality of pixels in horizontal and vertical direction of the image. The resolution of the camera depends on the number of pixels derived from the image. Typically a resolution of 512 pixels horizontal and 484 pixels vertical is sufficient for the present invention.

The composite video output of camera 630 is coupled to an image processor 632. The image processor is controlled by a microprocessor 640 and includes a frame grabber 638. The frame grabber converts the analog information corresponding to each pixel into a digital signal and stores the pixel information corresponding to a video frame on an image RAM (not shown). Adjacent pixels in the image have adjacent addresses on the image RAM both horizontally and vertically. Frame grabber 638 can provide pixel data on a row by row basis, wherein each row corresponds to a row of an actual video image.

Image processor 632 also includes a memory buffer 642. The output of frame grabber 638 is coupled to memory buffer 642. Desired data captured and stored in the frame grabber can be selectively retrieved and moved to memory 642. Program code and other operating data generated by image processor 632 is stored in RAM 644 which is coupled to microprocessor 640 and memory buffer 642.

Image processor 632 analyzes the image provided by image detector 630 and in the event of detecting an unauthorized entry onto the elevator cartop provides a signal to output buffer 646 which is coupled to microprocessor 646. The output of buffer 646 is coupled to a trigger system 648 which is set off upon detection of unauthorized entry. The trigger system is similar to the triggering circuits described with reference to FIGS. 1 through 5. The operation of the detection system of FIG. 7 is now explained in more detail.

Referring to FIGS. 6 and 7, camera 630 is mounted on a mounting bracket supported by mounting stand 622. The camera is positioned and its lens is adjusted so that only the elevator car top is within its viewing angle. The shaft-side roof of the elevator car may include moving parts like the elevator door movement mechanism which includes a moving chain rolled around two pulleys in the area on the elevator car top near and above the elevator doors. The moving parts on the shaft-side roof of the elevator car along with other moving images within the lens of the camera are considered background noise, which should be distinguished from actual unauthorized entry. One way to do so is simply to mask or block out the portions of the stored digital image that represent the relating position on the x-y of the moving parts on the optically translated physical image.

Another, more sophisticated method is to employ an intelligent system. The system functions in two modes: a training mode, and an operating mode. During the training mode the system is trained to set a threshold criteria above which an indication of unauthorized entry is detected. One way of determining such a threshold is described below.

First, during the training mode, the frame grabber periodically obtains information corresponding to the elevator car top, for example at twenty frames per second. For each frame, the frame grabber sends information corresponding to one row in the image to buffer memory 642. Each retrieved row is then compared with the same row corresponding to the previous frame. The number of bits in each row that has changed from the previous row is then stored. This is repeated for all rows corresponding to the entire image of the elevator car top. The process is repeated for a plurality of frames over a predetermined period of time, while the total number of bit changes from one frame to the other is calculated and stored. Preferably the process is repeated during the elevator's normal operation so that all movements and background noise not associated with an unauthorized entry are considered. Thereafter the system calculates the average number of bit changes from one frame to the other over the plurality of frames considered during the training mode.

The system is then set for the operating mode. The frame grabber continues to obtain information corresponding to each video frame and compares that information with the previous video frame on a row by row basis. If the total number of bit changes from one frame to the other is above the average number calculated during the training mode by a certain tolerance factor, then an unauthorized entry is assumed. The microprocessor sends an alarm condition to output 646, which in turn drives the trigger circuitry 648 to set off a siren or stop the elevator.

In the event that the elevator car top contains moving parts that are continuously in motion, like the chain door mechanism mentioned above, it is possible to mask the rows corresponding to the location of the door mechanism during the analysis of the rows of the frame grabber. This can be done by not retrieving row information corresponding to actual image rows that are within the area occupied by the door mechanism. Therefore, image information corresponding to those particular rows are never retrieved into buffer memory 642.

Referring now to FIG. 8(*a*) the schematic diagram of another unauthorized entry detection system based on a neural network mechanism is illustrated. Camera 630 is positioned at location 626 in FIG. 6, facing the elevator car front. As such, camera 630 is able to detect all images facing the car front, including the images of persons that have opened the elevator hoistway doors for illegal entry onto the elevator car roof. The output of camera 630 is coupled to a video frame grabber 638 as explained above with reference to FIG. 7. The output of video frame grabber is coupled to a video memory 650 for storing digital information corresponding to video images. The output of video memory 650 is coupled to an image recognition system 652 which contains a digital signal processor 654 and a neural network 656. The neural network, as will be explained in more detail, is capable of determining features corresponding to a human being and thus provides an accurate detection system that will trigger an alarm condition only upon the detection of a person. A typical neural network imaging system known as "SensUs" is available from Molynx Holdings in Newport, Gwent, England. An alternative system that integrates the CCD camera, the frame grabber and the microprocessor into one unit is available from VLSI Vision Lts., Edinburgh, Scotland.

A three layer neural network 656 is illustrated in FIG. 8(*b*). Nodes 664, 668 and 670 are arranged to be interconnected. The network can be trained to perform pattern recognition such as detection of certain human features, such as the general shape of a human face and body. The network has a number of successive layers, including an input layer consisting of nodes 664, one or more hidden layers consisting of nodes 668, and an output layer consisting of nodes 670. Every node of the input and hidden layers is connected to every node of the next successive layer through a respective weighted connection 666 known as weight wt. The outputs of the nodes of the input and hidden layers are multiplied by respective weight values wt which are set by microprocessor 658.

Referring to FIG. 8(*b*), the nodes of the neural network 656 in the different layers of a conventional feedforward neural network, also known as perceptron, sum all the weighted inputs at summing circuit 672. Each node subtracts a threshold value "ϕ" at subtracting circuit 674, and performs nonlinear processing on the result at processor 676 to provide an output. The output of all the nodes is coupled to the input of all the nodes of the next layer after being multiplied by the weight value wt corresponding to the node to which it is being directed.

A neural network is trained on a number of different training "examples". Training examples correspond to a set of data-like noise and various arrangements of people, along with a predicted response. The training examples are run using a number of weight configurations defined by different sets of weight values and, after all of the training examples have been run on all of the weight configurations, at least some of the weight values are modified and the training procedure is repeated. The process is repeated until optimum weight values are found such that the system can reject non-human targets.

Once the network is trained, it behaves like an intelligent look-up table, which has information about each set of data corresponding to human features presented to it. Based on the similarity of an image to those in its training set, the system returns its best determination of an alarm condition upon detection of an unauthorized entry. Upon such detection, microprocessor 658 sends an alarm condition to output 660, which in turn drives the trigger unit 662. The trigger unit may then indicate an alarm condition to a number of other elevator system inputs, such as the fire alarm, external elevator safety circuit or a monitoring station.

The preferred embodiment having been set forth herein, it is known that there can be departure therefrom without departing from the true scope and spirit of the invention as claimed herein.

We claim:

1. A detection system for detecting attempted entry into the shaft of an elevator cab comprising:

power supply means for supplying power to said system;

image acquisition means in electrical connection with said power supply means and being disposed in said shaft proximate said elevator cab for acquiring an image of a zone of detection in said shaft; and image processing means responsive to said image acquisition means for comparing a first image of said zone of detection in an un-intruded state with a second image of said zone in an intruded state and providing a detection signal when an object enters said detection zone in said intruded state, said image processing means indicating said attempted entry.

2. The invention according to claim 1 wherein said image acquisition means is a video camera obtaining images associated with the elevator car top on a frame by frame basis.

3. The invention according to claim 2 wherein said image processing means provides an alarm condition when changes from one said frame to the other is above a threshold level.

4. The invention according to claim 2 wherein said image processing means further comprises a neural network for detecting certain features of a human figure corresponding to said attempted entry.

5. A detection system for detecting attempted entry into the shaft of an elevator cab comprising:

an image acquirer disposed in said shaft proximately to said elevator cab for acquiring an image of a zone of detection in said shaft above the roof of said elevator cab; and an image processor responsive to said image for detecting the presence of an object within the zone of detection by comparing a first image of said zone in an un-intruded state with a second image of said zone in an intruded state and providing a detection signal when an object is detected to be present in said zone of detection, said image processor indicating said presence in said zone of detection.

6. The detection system according to claim 5 wherein said image acquirer is removably attached to said elevator cab facing downwardly for detecting images of the rooftop of said elevator cab.

7. The detection system according to claim 5 wherein said image acquirer is removably attached to said eleavtor cab facing an exterior hoistway door.

8. The detection system according to claim 5 wherein said image acquirer is a camera.

9. The detection system according to claim 8 wherein said image processor receives information corresponding to images acquired by said camera and generates an alarm condition when within a predetermined period of time a change above a given threshold is detected in said received information corresponding to said acquired images.

10. The detection system according to claim 8 wherein said image processor receives information corresponding to images acquired by said camera and generates an alarm condition when said information corresponds to a human figure.

11. A detection system for detecting attempted entry into the shaft of an elevator cab comprising:

an image detector for detecting the presence of an object within a zone of detection above the roof of said elevator cab, said image detector disposed fixedly in the shaftway above said elevator cab and having a variable image adjustment for adjusting images detected by said detector such that the same image of the roof of said elevator cab is detected while the elevator cab ascends towards said detector or descends away from said detector; and an image processor responsive to said image detector for providing a detection signal when an object is detected to be present in said zone of detection, said image processor indicating said presence in said zone of detection.

* * * * *